US009775387B2

(12) United States Patent
Parr

(10) Patent No.: US 9,775,387 B2
(45) **Date of Patent: *Oct. 3, 2017**

(54) GARMENT FOR PROTECTION FROM THE ELEMENTS

(71) Applicant: Becky Parr, Ann Arbor, MI (US)

(72) Inventor: Becky Parr, Ann Arbor, MI (US)

( * ) Notice: Subject to any disclaimer, the term of this patent is extended or adjusted under 35 U.S.C. 154(b) by 738 days.

This patent is subject to a terminal disclaimer.

(21) Appl. No.: 14/178,877

(22) Filed: Feb. 12, 2014

(65) Prior Publication Data

US 2014/0157483 A1 Jun. 12, 2014

Related U.S. Application Data

(63) Continuation of application No. 13/177,600, filed on Jul. 7, 2011, now Pat. No. 8,650,664.

(60) Provisional application No. 61/361,953, filed on Jul. 7, 2010.

(51) Int. Cl.

| | |
|---|---|
| ***A41D 3/00*** | (2006.01) |
| ***A41D 3/08*** | (2006.01) |
| *A41D 27/20* | (2006.01) |

(52) U.S. Cl.

CPC ..... *A41D 3/00* (2013.01); *A41D 3/08* (2013.01); *A41D 27/20* (2013.01); *A41D 2200/20* (2013.01)

(58) Field of Classification Search

CPC ..... A41D 3/02; A41D 15/04; A41D 2400/422
USPC ..... 2/84, 108, 85, 93, 94, 86–89, 69.5, 2/69–70, 83, 104, 456; 5/413 R, 5/417–420, 652–653, 482, 485, 656, 627, 5/625–626, 628; 224/155–156; 219/527
See application file for complete search history.

(56) References Cited

U.S. PATENT DOCUMENTS

| | | | | |
|---|---|---|---|---|
| 217,107 | A * | 7/1879 | Hodgman | A41D 3/02 2/85 |
| 353,743 | A * | 12/1886 | Goodrich | A41D 3/08 2/88 |
| 535,066 | A * | 3/1895 | Mautner | A41D 15/04 135/100 |
| 608,351 | A * | 8/1898 | Terramorse | A41D 15/04 135/115 |
| 1,102,408 | A * | 7/1914 | Hubner | A41D 1/02 128/872 |
| 1,273,765 | A * | 7/1918 | Gavin | 2/202 |
| 1,626,166 | A * | 4/1927 | Stair | A41D 13/0537 2/94 |

(Continued)

OTHER PUBLICATIONS https://www.groupon.com/deals/gg-ncaa-stadium-blanket-poncho-and-seat-cushion.

*Primary Examiner* — Gloria Hale
*Assistant Examiner* — Brieanna Szafran
(74) *Attorney, Agent, or Firm* — Ward Law Office LLC; Jacob M. Ward

(57) ABSTRACT

A garment for protection from the elements includes a blanket defined by an upper edge, a lower edge and a first side edge and a second side edge disposed between and connecting the upper edge and the lower edge, the upper edge, the lower edge, and the first side edge and the second side edge together forming a substantially rectangular shape, a hood connected to the blanket along the upper edge, a seat cushion assembly disposed on the blanket, the seat cushion assembly including a seat cushion pocket and a seat cushion removably disposed in the seat cushion pocket, and an attachment device attached to the seat cushion assembly circumscribing a waist of a wearer.

10 Claims, 3 Drawing Sheets

(56) References Cited

U.S. PATENT DOCUMENTS 2,140,797 A * 12/1938 Hammerman ..... A41B 13/06 128/873
2,676,319 A * 4/1954 Davidson ..... G21F 3/02 2/1
2,722,020 A * 11/1955 Gazelle ..... A41D 13/0012 2/93
3,096,759 A * 7/1963 Coolbaugh ..... A61F 17/00 2/84
3,185,362 A * 5/1965 Wakefield ..... A45F 3/00 2/24
3,228,034 A 1/1966 Grove
3,798,676 A * 3/1974 Shanks ..... A41D 13/00 2/69.5
3,835,471 A * 9/1974 Lankford ..... A41D 3/08 2/84
4,241,458 A * 12/1980 Lesesne ..... A47G 9/068 2/69.5
4,302,847 A * 12/1981 Miles ..... A41D 13/015 2/102
4,316,288 A * 2/1982 Henrickson ..... A41D 15/00 2/84
D310,929 S * 10/1990 Blau ..... 5/482
5,275,315 A * 1/1994 Carmack ..... A45F 3/00 2/94
5,414,881 A * 5/1995 Terrazas ..... A41D 15/04 190/1
5,564,125 A * 10/1996 Waldman ..... A41D 3/00 2/93
5,743,448 A * 4/1998 Tsai ..... A41D 15/04 2/69.5
5,884,331 A * 3/1999 Barajas ..... A41D 3/08 2/69
5,901,375 A * 5/1999 Davis ..... A41D 15/04 2/69
6,006,356 A * 12/1999 Song ..... A41D 1/00 2/102
6,243,873 B1 * 6/2001 Aliff ..... A41D 3/08 2/84
6,275,993 B1 * 8/2001 McCarley ..... A41D 15/04 2/209.11
6,353,933 B1 3/2002 Love
6,401,248 B1 * 6/2002 Christensen ..... A41D 3/08 2/69
6,708,343 B1 * 3/2004 Ceron ..... A41D 3/08 2/84
7,587,769 B1 * 9/2009 McDermott ..... A41B 13/06 2/69
D601,327 S * 10/2009 Anderson ..... D2/825
8,468,612 B1 * 6/2013 Galloway ..... A41D 23/00 2/207
8,485,596 B1 * 7/2013 Martin ..... A47G 9/066 2/84
8,650,664 B2 * 2/2014 Parr ..... A41D 3/08 2/84
9,155,341 B2 * 10/2015 Czarnik ..... A41D 15/04
2002/0129445 A1 * 9/2002 Deering ..... A47G 9/066 5/482
2005/0039241 A1 * 2/2005 Khan ..... A41D 13/00 2/86
2006/0064795 A1 * 3/2006 Houghton ..... A41D 23/00 2/88
2008/0028518 A1 * 2/2008 Miotke ..... A47G 9/06 5/482
2008/0209609 A1 * 9/2008 Panek ..... A41D 15/04 2/66
2008/0209612 A1 * 9/2008 Summers ..... A41D 15/04 2/84
2009/0165206 A1 * 7/2009 Davis ..... A47D 15/006 5/494
2010/0059558 A1 * 3/2010 Robinson ..... A41D 3/08 224/155
2010/0186166 A1 * 7/2010 Sulentic ..... A47G 9/064 5/494
2010/0205714 A1 * 8/2010 Pollack ..... A47G 9/066 2/69
2012/0005801 A1 * 1/2012 Parr ..... A41D 3/08 2/84
2012/0276802 A1 * 11/2012 Anderman ..... A63H 3/003 446/27
2013/0239290 A1 * 9/2013 Rossi ..... A41D 7/008 2/84
2014/0020177 A1 * 1/2014 Coates ..... A41B 13/06 5/494
2014/0157480 A1 * 6/2014 Czarnik ..... A41D 15/04 2/69
2014/0165254 A1 * 6/2014 Bowen ..... A47K 10/02 2/69
2014/0352063 A1 * 12/2014 Mitchell ..... A47G 9/0223 5/494

* cited by examiner

GARMENT FOR PROTECTION FROM THE ELEMENTS

CROSS-REFERENCE TO RELATED APPLICATIONS

This application is a continuation of U.S. patent application Ser. No. 13/177,600 filed on Jul. 7, 2011, issued as U.S. Pat. No. 8,650,664 on Feb. 18, 2014, which in turn claims the benefit of U.S. Provisional Patent Application Ser. No. 61/361,953 filed on Jul. 7, 2010. The entire disclosures of the above applications are hereby incorporated herein by reference.

FIELD OF THE INVENTION

The present invention relates to a garment for protection from the elements. More particularly, the invention is directed to a garment to be worn by a wearer at sporting events and the like that provides protection from the elements and includes a seat cushion allowing for ease of transition from a standing position to a seated position.

BACKGROUND OF THE INVENTION

The prior art provides several examples of garments that protect a user from inclement weather and that provide a seat cushion. Such garments include rain gear, blankets and wraps for warmth, and seat structures for seating comfort. There have been many attempts to design a garment that protects a user from inclement weather and that provides a seat cushion. However, those designs are generally cumbersome and inconvenient to wear.

U.S. Pat. No. 3,835,471 discloses protective apparel providing a cushion element for seating comfort. The protective garment wraps around the body of a wearer and is coupled with a cushion element. However, the cushion element is not removable from the garment to allow for maintenance of the garment alone, and the cushion element is not separately secured to the wearer, making movement from a standing position to a seated position inconvenient and difficult to maneuver.

U.S. Pat. No. 3,228,034 discloses a multi-purpose garment adapted to protect a wearer in inclement weather. The garment includes an upper portion and a lower portion having a sack-like appearance that encompasses the wearer from head to toe and includes a protective seat. The invention, however, is disadvantageous because the wearer must step into and out of the lower portion when applying or removing the garment and is not able to move from one place to another due to the sack-like structure surrounding the wearer's feet.

U.S. Pat. No. 6,353,933 describes a poncho and cushion combination used as a protective weather garment while sitting. The poncho is made from a water proof material and the cushion is attached to the inside surface of the poncho. The poncho and cushion combination of U.S. Pat. No. 6,353,933 is disadvantageous in that it does not provide a material to keep a wearer warm and the cushion is not separately connected to the wearer to allow for ease of transition from a standing position to a seated position.

It would be desirable to develop a garment that is readily transportable and convenient to wear that provides protection from inclement weather and a seat cushion allowing for ease of transition from a seated position to a standing position, and vice versa, for use at sporting events and the like.

SUMMARY OF THE INVENTION

Consonant with the present invention, a garment that is readily transportable and convenient to wear that provides protection from inclement weather and a seat cushion allowing for ease of transition from a seated position to a standing position, and vice versa, for use at sporting events and the like, has surprisingly been discovered.

In one embodiment, a garment comprises: a main body having an upper edge, a lower edge, a first side edge, and a second side edge cooperating to form a substantially rectangular shape; a hood connected to the main body at the upper edge; a seat cushion assembly disposed on the main body, the seat cushion assembly including a seat cushion pocket and a seat cushion removably disposed in the seat cushion pocket; and an attachment device attached to one of the main body and the seat cushion assembly circumscribing a waist of a wearer.

In another embodiment, a garment comprises: a main body having an upper edge, a lower edge, a first side edge, and a second side edge cooperating to form a substantially rectangular shape; a hood connected to the main body at the upper edge; a seat cushion assembly disposed on the main body, the seat cushion assembly including a seat cushion pocket and a seat cushion removably disposed in the seat cushion pocket, the seat cushion pocket having a first edge, a second edge, a third edge, and a fourth edge that cooperate to form a substantially rectangular shape; and an attachment device attached to the seat cushion assembly circumscribing a waist of a wearer, wherein the attachment device includes a first strap attached to a first edge of the seat cushion pocket, a second strap attached to a second edge of the seat cushion pocket, and a third strap attached to a third edge of the seat cushion pocket, the third edge disposed between and connecting the first edge and the second edge, and wherein the first strap and the second strap circumscribe a waist of a wearer and the third strap extends out from the third edge, through legs of the wearer, and connects to at least one of the first strap and the second strap.

In yet another embodiment, a garment comprises: a blanket having an upper edge and a lower edge, and a first side edge and a second side edge connecting the upper edge to the lower edge, the upper edge, the lower edge, the first side edge and second side edge together forming a substantially rectangular shape; a hood connected to the blanket along at the upper edge; a seat cushion assembly disposed on a midsection of the blanket, the seat cushion assembly including a seat cushion pocket and a seat cushion removably received in the seat cushion pocket; a pair of arm pockets disposed on the blanket; and an attachment device attached to the seat cushion assembly, wherein the attachment device includes a first strap attached to a first edge of the seat cushion pocket, a second strap attached to a second edge of the seat cushion pocket, and a third strap attached to a third edge of the seat cushion pocket, the third edge disposed between and connecting the first edge and the second edge, and wherein the first strap and the second strap circumscribe a waist of a wearer and the third strap extends out from the third edge, through legs of the wearer, and connects to at least one of the first strap and the second strap.

BRIEF DESCRIPTION OF THE DRAWINGS

The above, as well as other advantages of the present invention, will become readily apparent to those skilled in the art from the following detailed description of the preferred embodiment when considered in the light of the accompanying drawings in which.

DETAILED DESCRIPTION OF EXEMPLARY EMBODIMENTS OF THE INVENTION

The following detailed description and appended drawings describe and illustrate various embodiments of the invention. The description and drawings serve to enable one skilled in the art to make and use the invention, and are not intended to limit the scope of the invention in any manner.

Figure 1:
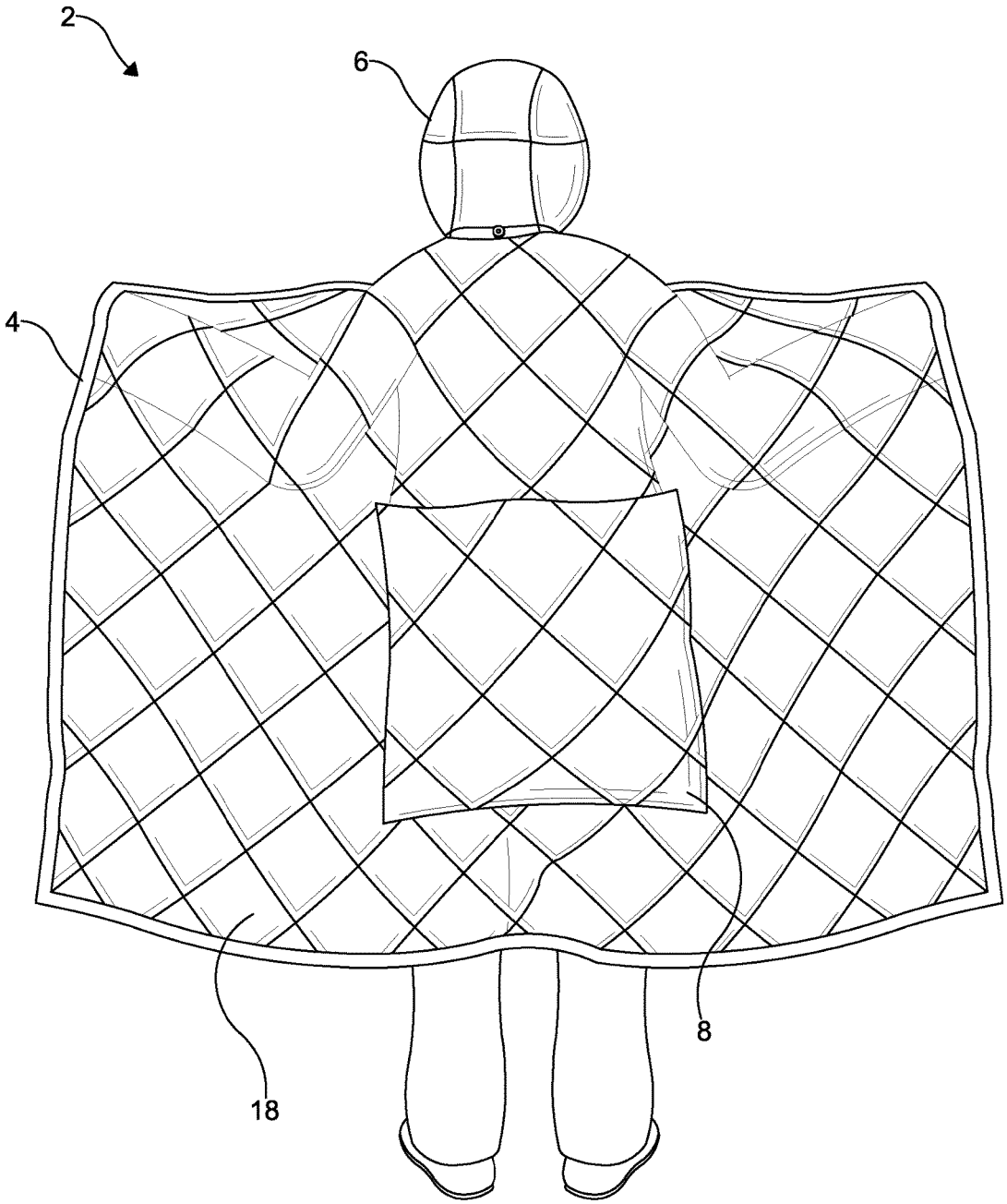
FIG. 1 is a rear perspective view of the garment for protection from the elements according to an embodiment of the present invention.
Figure 2:
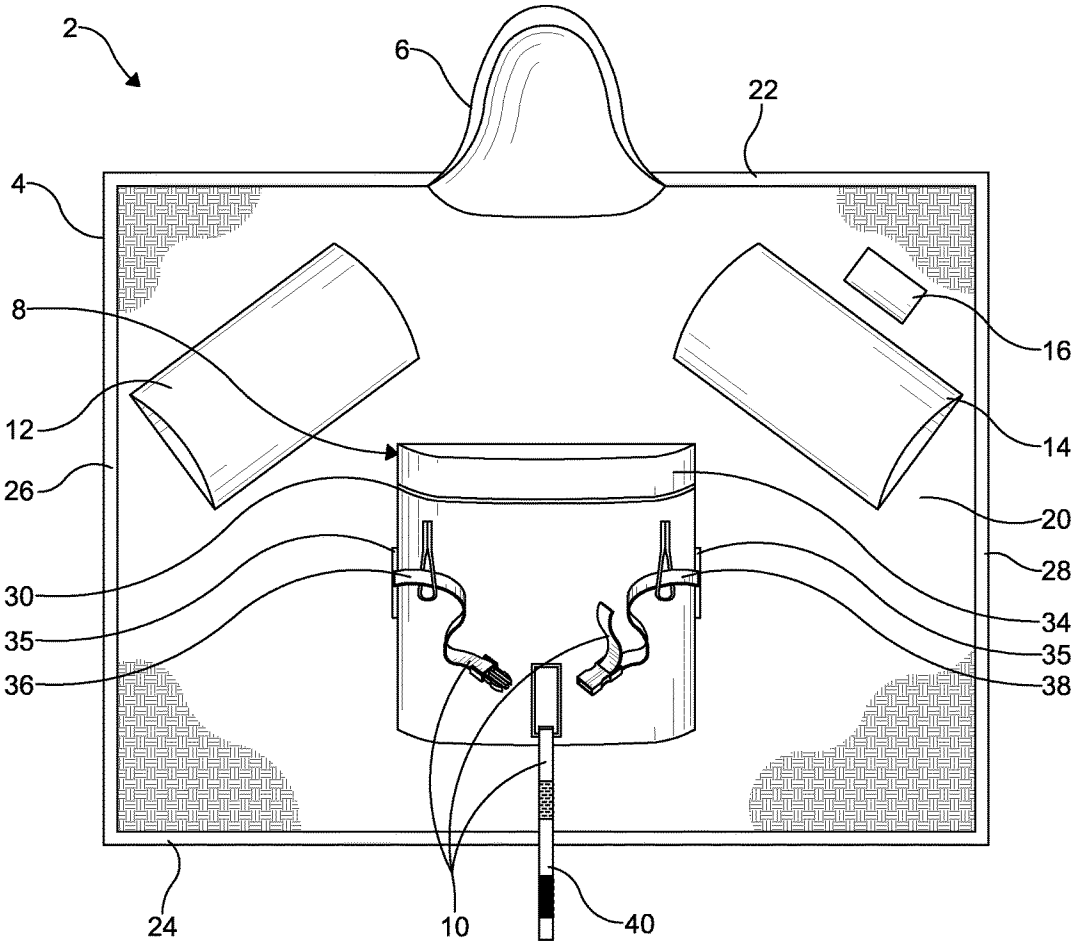
FIG. 2 is front elevational view of the garment for protection from the elements of FIG. 1.
Figure 3:
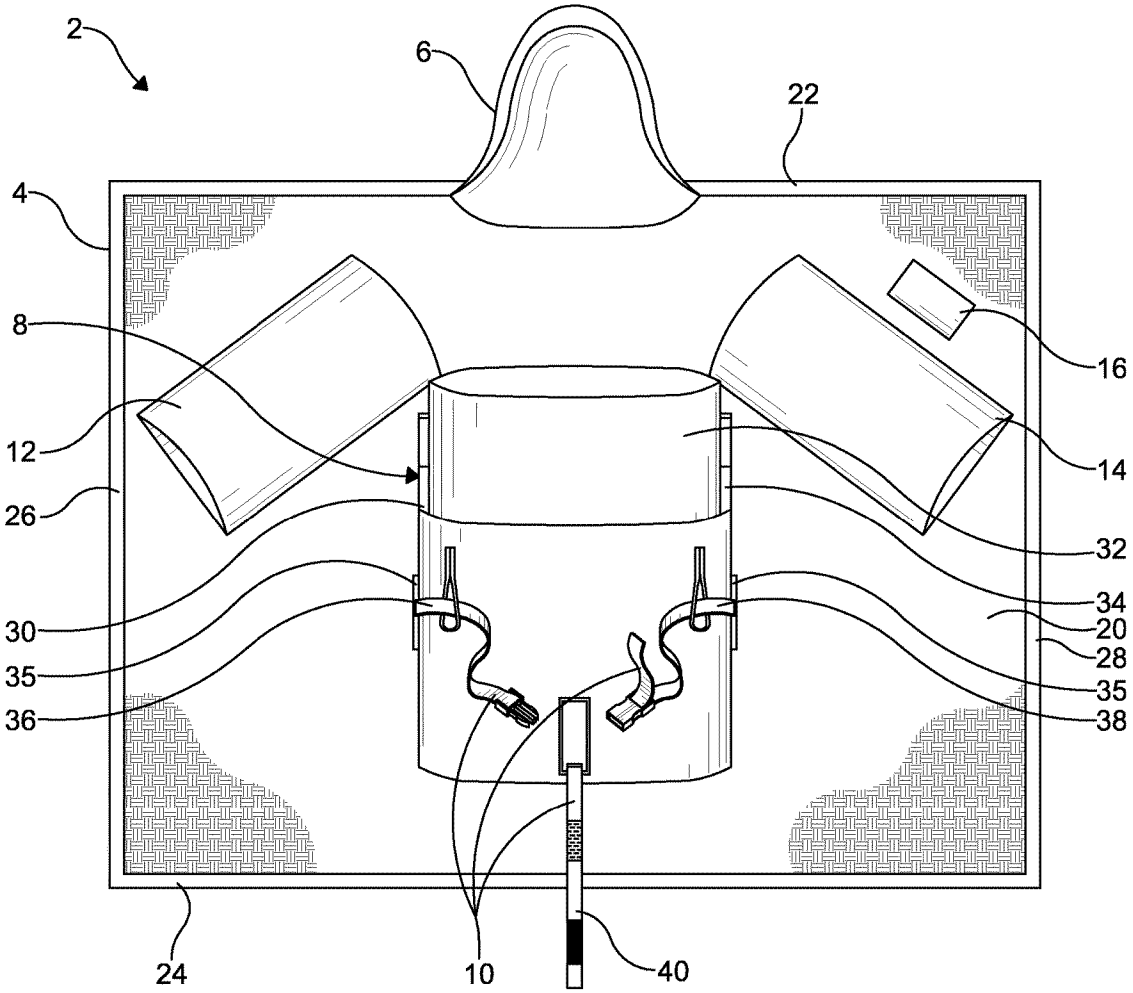
FIG. 3 is a front elevational view of the garment for protection from the elements of FIGS. 1 and 2 showing a seat cushion partially removed therefrom.

FIGS. 1-3 illustrate a garment for protection from the elements 2 according to an embodiment of the present invention. As shown, the garment 2 includes a substantially rectangular main body 4, a hood 6 attached to the main body 4, a seat cushion assembly 8 disposed on the main body 4, an attachment device 10 attached to the seat cushion assembly 8, two arm pockets 12, 14 disposed on the main body 4, and a storage pocket 16 also disposed on the main body 4. The main body 4 can be a blanket and the like, for example. As shown, the attachment device 10 is a belt, although other attachment devices can be used.

The main body 4 includes an outer material 18 and an inner material 20 secured to one another at least around a circumference of the main body 4. The outer material 18 is typically a moisture repellant material having a quilted stitching with an intermediate filling, such as down. However, any lightweight material conducive to repelling water that can be easily worn by a wearer of the garment 2 can be used, such as vinyl or rubber. The inner material 20 is typically a fleece or imitation fur. However, any comfortable and lightweight material having insulating properties or conducive to the return of heat energy to the wearer can be used. As shown in FIGS. 1 and 2, the main body 4 is generally rectangular in shape and includes an upper edge 22 and a lower edge 24 that are substantially parallel to one another, and two side edges 26, 28 disposed between the upper edge 22 and the lower edge 24 that are substantially parallel to one another. However, the main body 4 can be any shape covering the body of a wearer and militating against the escape of heat energy while keeping the wearer dry.

The hood 6 is attached to a midsection of the upper edge 22 of the main body 4. The hood 6 can include the same outer material 18 and inner material 20 as the main body 4, or any other materials as designed. The hood 6 is typically attached to the main body 4 by stitching or by other means including, but not limited to a fastening strip, hook and loop tape, buttons, a zipper or snap fasteners. The hood 6 can also be integrally formed with the main body 4. The hood 6 typically includes a drawstring or other device disposed around a circumference of the hood 6 for securing and further enclosing the hood 6 around a head of the wearer.

The seat cushion assembly 8 includes a seat pocket 30 and a seat cushion 32. The seat pocket 30 is disposed on a midsection of the main body 4 in an area that corresponds with a wearer's posterior end of the wearer in either a seated or standing position. Typically, the seat pocket 30 is in alignment with the hood 6. The seat pocket 30 shown is rectangular in shape, but can be any shape that receives the seat cushion 32. The seat pocket 30 is typically disposed on the inner material 20 of the main body 4. However, the seat pocket 30 can be disposed on the inner material 20 or the outer material 18, or the seat pocket 30 can be disposed between the outer material 18 and the inner material 20. The seat pocket 30 can be made from a water resistant material or a material which militates against the escape of heat energy, depending on whether the seat pocket 30 is disposed on the outer material 18 or the inner material 20. A closure device 34 for closing the seat pocket 30 may be disposed along a top edge of the seat pocket 30. The seat pocket 30 may include other closure devices such as a fastening strip, hook and loop tape, buttons, a zipper and snap fasteners, for example. In certain embodiments, the seat pocket 30 includes slits 35 on each side that allow the attachment device 10 to adjust to different wearers having variable heights.

The seat cushion 32 is typically made from foam or any padded material providing comfort and support to the wearer in a seated position. Typically, the seat cushion 32 is made from a lightweight material. The seat cushion 32 is generally rectangular in shape but can be any shape providing comfort and support to the wearer in the seated position.

As shown, the attachment device 10 is typically connected to the seat pocket 30, but can be connected to the main body 4 in areas adjacent the seat pocket 30. In certain embodiments, the attachment device 10 includes three straps: a first strap 36, a second strap 38, and a third strap 40. A first end of the first and second straps 36, 38 is connected to opposing sides of the seat pocket 30. The first strap 36 and the second strap 38 each extend through the slits 35, allowing the straps 36, 38 to adjust vertically for wearers having variable heights. A second end of the first and second straps 36, 38 includes an attachment device. The attachment devices of the second ends are adapted to connect with one another. The third strap 40 extends upward from the bottom of the seat pocket 30 and connects to one or both of the first and second straps 36, 38. Each of the three straps 36, 38, 40 is typically made from a durable material such as polyester or other durable material. Each of the three straps 36, 38, 40 can be adjustable in length. The attachment device of the first and second straps 36, 38 may include a snap closure, a fastening strip, a belt hook, hook and loop tape, or other attachment device, for example. The third strap 40 may connect to one or both of the first and second straps 36, 38 using hook and loop tape or other connecting means. Each of the three straps 36, 38, 40 is typically connected to the seat pocket 30 by stitching or other means to securely connect the three straps 36, 38, 40 to the seat pocket 30.

The arm pockets 12, 14 are typically disposed on the inner material 20 and are made from a material militating against the escape of heat energy. Typically the arm pockets 12, 14 are connected to the inner material 20 by stitching or any other means for securely connecting the arm pockets 12, 14 to the inner material 20. The arm pockets 12, 14 can have openings at one end for insertion of the wearer's hands into each of the arm pockets 12, 14 or at both ends for insertion of the wearer's hands through the arm pockets 12, 14. Openings at both ends of the arm pockets 12, 14 permit the arm pockets 12, 14 to perform more like sleeves and allow the wearer to use their hands easily. The arm pockets each having spaced apart, parallel, straight edges affixed to the inner material of the main body. Each of the arm pockets are disposed entirely on the inner material and the within the perimeter of the main body as shown in FIGS. 2-3. Openings at both ends of the arm pockets are located between the spaced apart, parallel straight edges of each respective arm pocket. Further, a length of each of the straight edges is greater than a width of each of the openings of the arm pockets. The arm pockets 12, 14 are typically disposed at an angle with respect to the upper edge 22 or the side edges 26, 28, as seen in FIG. 2, but can be disposed on the blanket 4 in any direction conducive to freedom of movement by the wearer.

The storage pocket 16 can be disposed on the inner material 20, the outer material 18, or between the outer material 18 and the inner material 20. The storage pocket 16 can be made from a water resistant material or a material which mitigates against the escape of heat energy depending on whether the storage pocket 16 is disposed on the outer material 18 or the inner material 20. A closure device or other means for closing the storage pocket 16 may be disposed along an edge of the storage pocket 16. The means for closing the storage pocket 16 may include a flap, a fastening strip, hook and loop tape, buttons, a zipper, or snap fasteners, for example. The storage pocket 16 is typically attached to the main body 4 by stitching or any other means for securely connecting the storage pocket 16 to the outer material 18 or the inner material 20. The storage pocket 16 can vary in size and shape depending on the item to be stored.

In use, the garment 2 is worn by the wearer and provides protection from inclement weather and comfort and support when the wearer is seated at a sporting event or the like. The garment 2 can be worn by inserting arms into the arm pockets 12, 14 and placing the hood 6 over the head of the wearer, and adjusting the drawstring as necessary. The main body 4 can be wrapped around the body of the wearer using the arm pockets 12, 14, or opened to allow for ventilation based on the weather conditions. The outer material 18 of the garment 2 protects the user from rain and snow, while the inner material 20 provides additional warmth to the wearer. As such, the wearer is able to stay dry and warm throughout an outdoor event. In the event that a wearer becomes too warm while wearing the garment 2, or no longer needs protection from rain or snow, the wearer can remove the garment 2 and continue to use the seat cushion assembly 8 when seated. The opening at the bottom of the garment 2 through which the wearer's legs extend allows for freedom of movement by the wearer.

In the seated position, the wearer can maintain the garment 2 in either a closed position or an open position. The seat cushion 32 can be inserted into the seat pocket 30 when the garment 2 is in use and prior to the wearer sitting down. The seat cushion 32 provides comfort and support for the posterior end of the wearer in the seated position. The three straps 36, 38, 40 of the attachment device 10 secure the seat cushion assembly 8 to the midsection and posterior end of the wearer. The first strap 36 and the second strap 38 encircle a waist of the wearer like a belt and are connected to one another using the attachment devices. The third strap 40 extends out from the seat cushion assembly 8, through the legs of the wearer, and connects to one or both of the first and second straps 36, 38. The three straps 36, 38, 40 coordinate with one another in such a manner so that the seat cushion 32 does not shift up and down or side to side on the wearer as the wearer transitions from the seated to the standing position and vice versa. Additionally, the three straps 36, 38, 40 further secure the overall garment 2 to the wearer when the garment 2 is in use.

The garment 2, when not in use, folds into a compact rectangular shape the size of the seat cushion assembly 8 for easy transportability and easy storing. The seat cushion 32, in the folded configuration, is capable of providing comfort and support even when the protective garment 2 is not being used. As illustrated in FIG. 3, the wearer can remove the seat cushion 32 from the seat pocket 30 to allow for easy cleaning and maintenance of the blanket 4.

The angled arm pockets 12, 14 are disposed on the main body 4 in such a manner as to provide the wearer with pre-formed, comfortable arm positions and a way of wrapping the blanket 4 around the wearer's body. The additional storage pocket 16 allows for storage of personal items such as keys, wallets and cell phones, and the closure device prevents any personal items from falling out of the storage pocket 16.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A garment comprising:

a main body having an upper edge, a lower edge, a first side edge, and a second side edge cooperating to form a substantially rectangular shape and defining a perimeter of the main body, the main body having an outer surface and an inner surface, the main body including a pair of arm-securing pockets, each of the arm-securing pockets having a pair of spaced-apart, parallel, straight edges affixed to the inner surface of the main body, the pair of spaced-apart, parallel, straight edges of each of the arm-securing pockets together creating an opening at each end of the arm-securing pockets such that each of the arm-securing pockets are adapted to receive an arm of a wearer, and a length of each of the straight edges being greater than a width of each of the openings, each of the arm-securing pockets disposed entirely on the inner surface of the main body, and each of the arm-securing pockets disposed entirely within the perimeter of the main body;

a hood connected to the main body at the upper edge;

a seat cushion assembly disposed on the main body, the seat cushion assembly including a seat cushion pocket and a seat cushion removably disposed in the seat cushion pocket; and an attachment device attached to one of the main body and the seat cushion assembly adapted to circumscribe a waist of the wearer.

2. The garment according to claim 1, wherein the main body is a blanket including an inner material and an outer material connected to each other at the upper edge, the lower edge, the first side edge, and the second side edge.

3. The garment according to claim 2, wherein the inner material is one of fleece and imitation fur and the outer material is a moisture repellant material.

4. The garment according to claim 1, wherein the seat cushion pocket includes at least two slits configured to accommodate vertical movement of the attachment device.

5. The garment according to claim 1, wherein the arm-securing pockets are angled with respect to the upper edge.

6. The garment according to claim 1, wherein the seat cushion pocket includes a closure device including at least one of a flap, a snap closure, a zipper and hook and loop tape.

7. The garment according to claim 1, wherein the garment is foldable to result in substantially the same perimeter as the seat cushion assembly.

8. The garment according to claim 1, wherein the hood includes a drawstring.

9. The garment according to claim 1, wherein the main body includes a storage pocket having at least one of a flap, a snap closure, a zipper, and hook and loop tape.

10. A garment comprising:

a main body having an upper edge, a lower edge, a first side edge, and a second side edge cooperating to form a substantially rectangular shape and defining a perimeter of the main body, the main body having an outer surface and an inner surface, the main body including a pair of arm-securing pockets, each of the arm-securing pockets having a pair of spaced-apart, parallel, straight edges affixed to the inner surface of the main body, the pair of spaced-apart, parallel, straight edges of each of the arm-securing pockets together creating an opening at each end of the arm-securing pockets such that each of the arm-securing pockets are adapted to receive an arm of a wearer, and a length of each of the straight edges being greater than a width of each of the openings, the straight edges oriented at an angle relative to the upper edge of the main body, each of the arm-securing pockets disposed entirely on the inner surface of the main body, and each of the arm-securing pockets disposed entirely within the perimeter of the main body;

a hood connected to the main body at the upper edge;

a seat cushion assembly disposed on the main body, the seat cushion assembly including a seat cushion pocket and a seat cushion removably disposed in the seat cushion pocket; and an attachment device attached to one of the main body and the seat cushion assembly adapted to circumscribe a waist of the wearer.

* * * * *